United States Patent [19]

Meadows

[11] 4,052,732

[45] Oct. 4, 1977

[54] APPARATUS FOR DEVELOPING AND FIXING HEAT SENSITIVE FILM

[75] Inventor: John W. Meadows, Los Altos, Calif.

[73] Assignee: Quantor Corporation, Mountain View, Calif.

[21] Appl. No.: 597,800

[22] Filed: July 21, 1975

[51] Int. Cl.[2] ..... G03D 13/00

[52] U.S. Cl. ..... 354/297; 355/100; 355/106

[58] Field of Search ..... 354/297, 299; 355/100, 355/103, 106, 107, 78, 97; 219/388 R, 388 W; 34/156

[56] References Cited

U.S. PATENT DOCUMENTS

| | | | |
|---|---|---|---|
| 3,293,775 | 12/1966 | Kitrosser | 34/156 |
| 3,372,630 | 3/1968 | Schmidt | 34/156 X |
| 3,718,983 | 3/1973 | Crowell | 34/156 |
| 3,774,520 | 11/1973 | Smith et al. | 355/100 |
| 3,775,711 | 11/1973 | Burgess et al. | 355/100 |
| 3,817,618 | 6/1974 | Riley et al. | 355/97 X |
| 3,863,360 | 2/1975 | Stievenar | 34/156 X |
| 3,867,031 | 2/1975 | Hakanson | 355/78 |

*Primary Examiner*—Richard L. Moses

*Attorney, Agent, or Firm*—Townsend & Townsend

[57] ABSTRACT

A film developer-fixer for diazo, vesicular or similar film in which the exposed film is developed by subjecting it to high temperature. The film is moved continuously at a constant speed past a developing station defined by a pair of opposing, spaced apart heating platens; the spacing between the platens exceeds the thickness of the film. Heated air is blown against the film emulsion to generate an air bearing for the film. Downstream of the developing station is a film cooling station and downstream of the cooling station a fixing station where the developed emulsion is subjected to light to permanently fix the images thereon. The cooling and the fixing stations are disposed in cavities defined by a supporting structure and they communicate with a source of cooling air for cooling the film and the components of the apparatus. Transport means is defined by a plurality of roller sets having polished surfaces. The rollers are rotated at a speed equal to the speed of the film, their spacing is less than the length of the film (in the direction of travel) so that the film is always positively advanced in a downstream direction and means is provided for cooling the rollers with cooling air supplied to the support structure cavities mentioned above.

17 Claims, 2 Drawing Figures

APPARATUS FOR DEVELOPING AND FIXING HEAT SENSITIVE FILM

BACKGROUND OF THE INVENTION

The present invention relates to film developing and fixing apparatus particularly adapted for use in connection with high speed, high volume duplicators for making one or more copies of a microfiche master.

In the commonly owned, co-pending U.S. patent application, Ser. No. 504,490, filed Aug. 29, 1974 for FILM DUPLICATOR now U.S. Pat. No. 3,958,142, the disclosure of which is incorporated herein by reference, a high volume, high speed and very economical microfiche duplicator is described and claimed. Generally speaking, that duplicator provides that a master fiche be positioned at a transfer station and that copy film be incremently advanced past the transfer station for "contact printing". After the copy film has been contact printed it is severed from a supply of copy film and placed on a conveyor system which transports the exposed copy film to a film developer where the film is heated, to cooling means for reducing the film temperature, and thereafter past a re-exposure or fixing station where the developed film is again subjected to light to permanently fix the images on the film.

The duplicator disclosed in the referenced U.S. patent employs a conventional film processor for developing and fixing the film. Transport belts advance the exposed film sections through the processor and at the developing and the fixing stations the film movement is arrested for the required length of time to heat and thereby develop the exposed emulsion and to fix the images thereon, respectively. The cooling was accomplished by intimately biasing the film sections into contact with a relatively large diameter cooling drum.

Generally speaking, such prior art processors are disadvantageous in that they require intermittent motion, that is a stop and go conveyor. This requires relatively complicated controls which render the processor expensive. Such intermittent motion is necessary since the emulsion becomes soft and pliable when heated to the developing temperature of about 200°-300° F. When the substance is soft it cannot move relative to stationary components of the film processor because such relative movement can result in surface deformation and damage and a resulting useless film copy.

This problem is particularly severe when belt conveyors are used because they must grasp and/or bias the film against a mating belt, a drum or the like, and since the freshly developed film remains relatively soft. Numerous attempts have been made to overcome this problem, including the use of large cooling drums against which the film is biased after it leaves the developing station, where a drum rotates at the same speed with which the transport belt moves. Although such a construction can prevent relative movements and surface damage therefrom, to achieve a satisfactory cooling rate relatively high contact pressures between the film and the cooling drums are required. These contact pressures are obtained by firmly biasing the transport belt against the drum surface. This biasing pressure and slight surface irregularities in the drum and/or the belt can be sufficient to cause surface indentations which are impressed on the film and which can distort the magnified image to an extent which can make it difficult or impossible to read on a conventional microfiche reader.

In summary, it can be stated that prior art heat sensitive film processors were inefficient in use, relatively expensive to construct and maintain, and had a tendency to cause damage to the fiche. For high quality microfiche records such damage is normally unacceptable. As a compromise the processors were operated at relatively low rates or they required relatively long travel paths for the film to give the film the necessary stay-time within the processors to accomplish all developing-fixing steps. Thus, prior art processors rendered prior art film duplicators and the like relatively expensive and bulky.

SUMMARY OF THE INVENTION

The present invention provides a film processor particularly adapted for use with high speed microfiche duplicator which is relatively inexpensive to build and use and which is substantially smaller than prior art processors. Yet, it does not change surface damage to the film emulsion while the emulsion is warm and soft even when the processor is operated at high speed.

The present invention contemplates the construction of a film processor which has a developing station defined by a pair of opposite, spaced apart heating platens. The spacing between the platens is greater than the thickness of the film passing therethrough and the platen facing the emulsion side of the film includes a multiplicity of orifices distributed over its surface through which heated gas, e.g., air is blown against the copy film as it moves past the developing station. The air heats the emulsion to the developing temperature and forms an air cushion or air bearing between the soft emulsion side and the adjacent side of the heating platen to prevent direct contact between the two as the film moves along.

In the preferred embodiment of the invention the platen includes internal passageways for the air and a heater to heat the walls defining the passageways to thereby heat the air to the desired temperature. Suitable insulation is provided to minimize the heat loss from the platen and to prevent an excess heat transfer from the platen to the surrounding support structure.

The support structure defines an elongate path for the film from an intake end of the film past the developing station and through spaced apart first and second cavities to an outlet or downstream end from which the fully developed and fixed film exits. The first cavity is downstream of the developing station and within it a pair of spaced apart, perforated plates are mounted. The spacing between the plates again exceeds the film thickness, Cooling air is forced through the perforated plates facing the emulsion to cool the film and form an air bearing over which the film travels.

A re-exposure or fixing station is defined by a suitable light source such as a pulsating xenon gas discharge lamp disposed in the second cavity of the support structure. Reflectors are provided to concentrate the light emitted by the source on the film as it passes the fixing station. Electric circuitry is preferably provided to intermittently operate and pulsate the xenon lamp when film passes the fixing station while it deactivates the xenon lamp when no film is present to minimize energy consumption and the amount of heat generated by the processor. The support structure further includes a suitable cooling air inlet which communicates with the first and second cavities to cool the film between the perforated platens in the second cavity and to cool the light source, associated reflectors and the like at the fixing station.

The processor includes transport means, preferably a plurality of cooperating roller sets which advance the film along its path through the processor. The spacing between the roller sets is less than the length of the film being processed so that a portion of the film is at all times engaged by a roller set. This assures a positive transport of the film through the processor. Furthermore, the surfaces of the rollers are highly polished, they operate continuously and at constant and like surface speeds to prevent any relative motion between their surfaces and film passing therebetween to thereby prevent possible damage to the film, its substrate and/or its heat softened emulsion. At least the rollers downstream of the developing station are cooled, preferably by constructing them hollow or with axial passageways through which cooling air can flow. This maintains the operating temperature of the rollers low and further aids in cooling the film after it has been heated at the developing station and again after is has passed the fixing station.

From the above description it will be apparent that the processor of the present invention eliminates direct contact between the film emulsion, particularly when it is heat softened, and stationary components of the processor by virtue of the air bearing between them. Thus, the heretofore common problem of emulsion surface damage is overcome. When the film is in direct contact with hard objects such as the transport rollers, the film and the rollers move at like speeds and, since the rollers are rigid objects (as distinguished from flexible belts) they can be highly polished so that surface damage, indentations and the like due to surface irregularities and large contact pressures are prevented. The film can be continuously moved, without the need for arresting its movement for the performance of certain operations as was common in the prior art to thereby greatly simplify the construction of the processor. Furthermore, the heat transfer between the heated, turbulent air forming the air bearings and the film (both to heat the film and to thereafter cool it) is very efficient and can be sequentially performed as the film moves along. Consequently, the temperature of different film portions may vary as the film moves past the developing station, for example.

The overall length of a processor constructed in accordance with the present invention can be greatly reduced. For example, for a standard microfiche processor in which the microfiche copies move at a speed of about 2 inches per second an overall processor length of only about 18 inches (with only about 10 inches between the centers of the film developing station and the film fixing station) is sufficient. In contrast, prior art processors with a comparable fiche capacity have an overall length of up to about 3–4 feet.

It is apparent, therefore, that the present invention affords great cost savings in the construction, use and maintenance of the processor and further cost savings due to a reduced bulk of the processor (or film duplicator of which the processor may form part) with resultant reductions in floor space and general overhead costs for the processor.

DESCRIPTION OF THE PREFERRED EMBODIMENTS

Figures 1, 2:
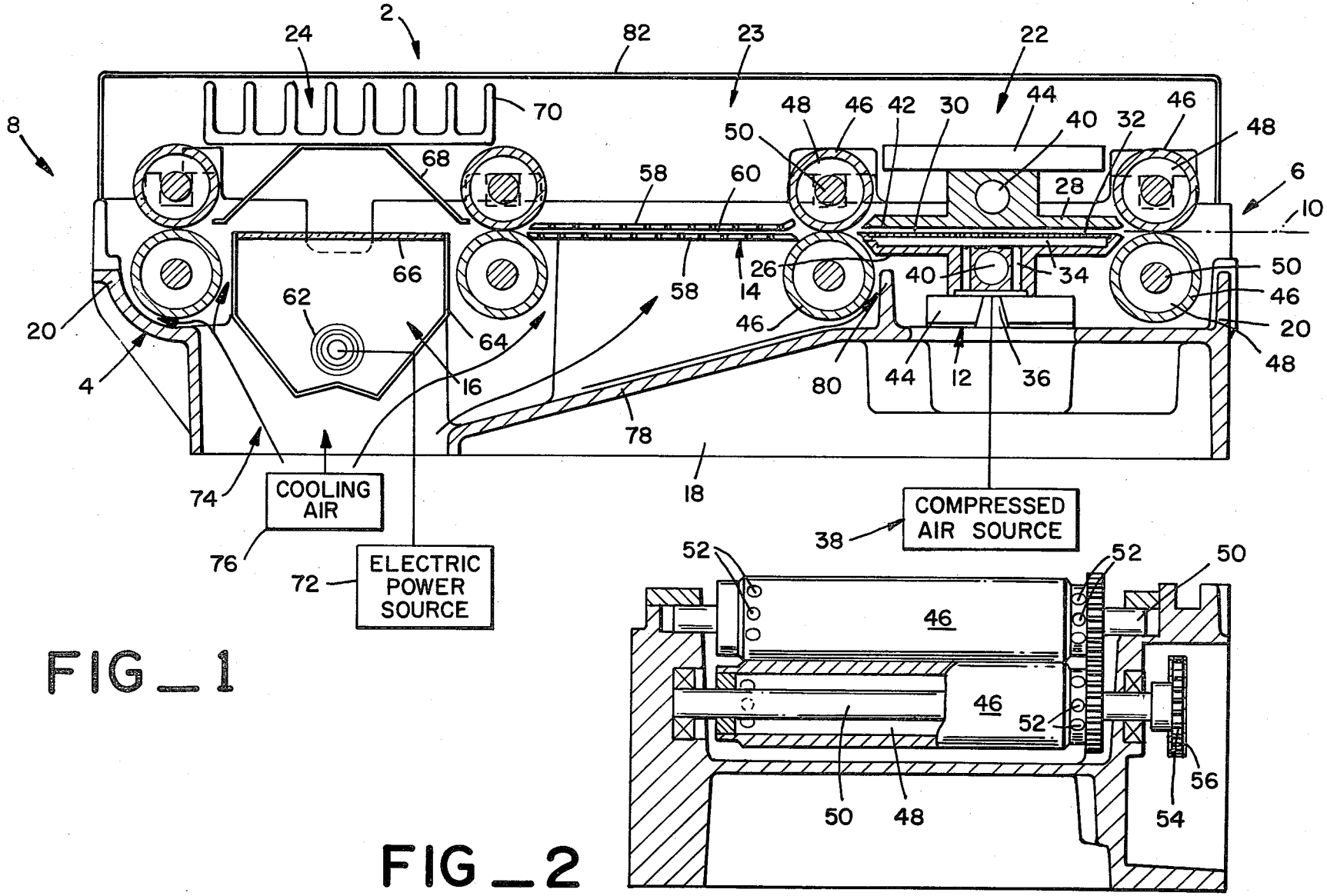
FIG. 1 is a side elevational view, in section of a film processor constructed in accordance with the present invention and is taken along a line generally parallel to the travel path of film through the processor.
FIG. 2 is a fragmentary, side elevational view, also in section, and illustrates the construction of the film transport rollers in greater detail.

Referring to the drawings, a film processor 2 constructed in accordance with the present invention generally comprises an elongated support structure 4 which has an inlet end 6 and an outlet end 8. An elongate, straight film travel path 10 extends therebetween. A developing station 12, a film cooling station 14 and a fixing or re-exposure station 16 are serially arranged along the film travel path and within the support structure. The support structure itself is sufficiently rigid and strong to mount the film processing components as set forth below. For that purpose it is preferably a light weight, aluminum casting which has side walls 18, end walls 20 and interior partitions to define three generally spaced apart internal cavities 22, 23 and 24 for the developing, the cooling and the fixing stations, respectively. In actual use the processor of the present invention is preferably installed in and forms part of a film or microfiche recorder or duplicator such as the duplicator described in the earlier referenced U.S. patent application.

Developing station 12 is immediately downstream of inlet end 6 and comprises first and second platens 26 and 28. They define between them a gap 30 which has a thickness greater than the thickness of film being handled by the processor. The lower platen includes a porous member 32 which has a multiplicity of evently distributed orifices facing the gap between the platens. The lower platen includes interior passages 34 which communicate the porous plate with an air intake 36 for connection to a source of pressurized air 38. The lower platen further includes a heater 40 which is positioned so that air passages 34 surround it for heating air from source 38 to the required temperature to develop the film.

Upper platen 28 is similarly constructed to lower platen 26 except that it normally does not include a porous insert and internal air passages. Instead, the upper platen is solid and defines a solid, highly surface polished face 42. The upper platen also includes an internal heater 40 for heating and platen. The side of both platens facing away from gap 30 are covered with suitable insulation plates 44 to minimize the heat loss from the platens.

A pair or set of opposing transport rollers 46 is positioned just upstream of the developing station for grasping film to be developed between them and advancing the film in a downstream direction past the developing station. Each roller has a hollow interior 48 and is secured to a shaft 50 journaled on roller bearings mounted to side walls 18 of the support structure. The roller includes a plurality of generally radially oriented apertures adjacent each end to communicate the roller interior with the exterior so that cooling air can freely circulate through the interior of the rollers for purposes more fully discussed hereinafter. One end of the roller shaft 50 protrudes past side wall 18 and is fitted with a sprocket wheel 54 which in turn is driven by a chain 56 for rotating the rollers. The chain driven rotates the rollers in opposite direction at like and constant speeds so that film entering between the rollers is grasped and advanced in a forward direction without relative movements between the film surfaces and the roller exterior in contact with such surfaces.

To prevent the formation of indentations, scratches and the like on the film surfaces when the film passes between the rollers the exterior of the rollers is highly polished. Preferably the exterior is hard chrome-plated and buffed to a mirror finish to assure a smooth surface and prevent film damage even when the film is heated and its emulsion softened.

A second set of rollers 46 is positioned downstream of the developing station and aligned with gap 30 between platens 26 and 28 to receive film from the developing station and to transport the film in a downstream direction. The spacing between the roller sets upstream and downstream of the developing station is less than the length of film being processed. For example, when processing standard size microfiche, which has a length of about six inches, the spacing between the roller sets is less than six inches, e.g. five inches. A portion of the microfiche is thus always disposed between a roller set for positively advancing the microfiche is a downstream direction.

A pair of perforated platens constructed of a suitable material such as stainless steel is mounted within second cavity 23 just downstream of the second roller set. The perforated plates defined between them another gap or channel 60 of about the same width as gap 30 so that film advanced downstream by the second roller set is guided through the channel between the plates. As will be more fully discussed below, pressurized cooling air is admitted into the channel through the perforations in the lower plate 58 for cooling the film received from the developing station.

Another roller set is positioned just downstream of the perforated plates and spaced from the roller set upstream of the plates as discussed above to assure a continuous, positive film movement through the processor.

The film fixing or re-exposure station 60 is defined by a light source 62, e.g., a xenon gas discharge lamp constructed as discussed in the above referenced U.S. Pat. No. 3,958,142. The light source is disposed within a funnel-shaped optical horn 64 and beneath a transparent glass plate 66 which defines the film travel path 10 past the fixing station. A top reflector 68 including a heat dissipator 70 attached thereto may be provided to maximize the amount of light to which the film is exposed when it passes the fixing station. Another set of transport rollers is disposed just downstream of the glass plate 66 and is again spaced from the roller set upstream of the glass plate as above described to assure a positive film drive through the processor. Film advanced downstream by the last roller set is then discharged through the outlet end 8 into a suitable receptacle (not shown).

The xenon lamp is driven by an electric power source 72 which activates the lamp only in response to the presence of a film in the vicinity of fixing station 60 and which further pulsates the lamp. In this manner, energy consumption as well as heat generated by the lamp are minimized for an efficient operation of the processor and a reduced cooling requirement therefor. The construction of such a power source is set forth in detail in the above referenced U.S. patent.

Support structure 4 has a generally closed base and includes a cooling air intake opening 74 beneath fixing station 60 which is suitably connected to a source of cooling air 76. A floor plate 78 of the base slopes upwardly from the cooling intake towards developing station 12 and communicates the cool air intake with the second cavity 23. A transverse barrier 80 just upstream of the second roller set between the developing station and the cooling station prevents any significant cooling air flow from reaching the heated platen 26 of the film developer. Cooling air does flow however through the perforations in the lower perforated plate 58 at the cooling station, around optical horn 64, top reflector 68 and around rollers 46 as well as through the hollow interior roller spaces 48 of all rollers downstream of the developing station to cool all operating components of the processor which are not intended to heat the film. A louvered top cover 82 is placed over the processor to physically protect the interior components and to permit the discharge of cooling air from the upper half of the processor.

Turning now to the operation of film processor 2, heaters 40 at the developing station are activated to raise the temperature of platens 26, 28 sufficiently so that when pressurized air is introduced into air passages 34 the air is heated to the desired developing temperature, e.g. 200°-300° F. Roller drive chains 56 are activated to rotate the rollers of each roller set in opposite directions so that film between the rollers is moved downstream. The rollers are rotated so that their surface speeds are equal, i.e. when the rollers have identical diameters, their rate of rotation is identical. Compressed air source 38 and cooling air source 76 are activated to flow compressed air through lower platen 26 and porous plate 32 into gap 30 and to flow cooling air through the lower perforated plate 58 into gap 60 while cooling the optical horn, both perforated plates and all rollers downstream of the developing station.

Film to be exposed is introduced into the processor so that its emulsion side faces down. The roller pair upstream of the developing station grasps such film and passes it into gap 30 between plates 26 and 28. The heated airstream flowing from porous plate 32 forms an air bearing or air cushion between the emulsion side of the film and the porous plate and at the same time heats the emulsion side to its developing temperature. The back side of the film, that is the transparent film substrate slides along the polished face 42 of upper platen 28 past the developing station. Thus, as the film progresses through gap 30 it temperature gradually increases to the desired value while any physical contact between the emulsion side, which softens as its temperature increases, and solid objects, e.g., platen 26 or porous plate 32 is prevented to eliminate the possibility of damage to the emulsion.

As the leading edge of the film is discharged from gap 30 it enters between the roller pair downstream of the developing station. The roller pair upstream of the developing station still feeds, i.e. pushes the film downstream when the second roller pair grasps the film to assure a continuous movement. Since all roller surfaces rotate at the same speed with which the film moves, relative movements between them and the film, and particularly between the heated and softened emulsion side and the lower roller in contact therewith are prevented. Since the roller surfaces are highly polished, scratches or indentations from roller surface irregularities are prevented to assure a perfect, high quality microfiche.

The second roller pair discharges the still warm film into gap 60 between plate 58 at the cooling station. There cooling air passes through the perforations in the plate into gap 60 to again form an air bearing between the emulsion side and the lower plate while the film cools. It should be noted that the contact of the film with the cooled rollers also helps to cool the film. The third roller pair, downstream of the cooling station grasps the film as above described and advances it over glass plate 66 past the fixing station. A suitable sensor (not shown) energizes power source 72 for xenon lamp 62 when the leading edge of the film arrives at glass plate 66. Thereafter, high intensity light pulses are emitted by the light source to fix the images on the film emulsion which were previously developed while the film passed through gap 30 between heated platens 26 and 28. Thereafter, the fourth roller set grasps the leading film edge and advances the now finish processed film through the outlet end 8 of the support structure into a receptacle. The film is ready for immediate use.

I claim:

1. Apparatus for developing and fixing exposed film having a light sensitive emulsion on a substrate of the film, the apparatus comprising: a developing station including first and second opposing platens defining therebetween a gap having a width greater than the thickness of the exposed film; transport means for continuously moving the exposed film past the developing station; means for heating the emulsion to its curing temperature as the film moves past the developing station; a fixing station disposed downstream of the developing station; means disposed between the developing station and the fixing station for cooling the film; the transport means including roller means for transporting the film through the developing station, the cooling means and the fixing station; and means for driving the roller means at a rate so that the film moves at a speed of at least about two inches per second.

2. Apparatus according to claim 1 wherein the first plate faces the emulsion and includes a multiplicity of gas flow passages opening towards the emulsion and including means connected to the first platen for flowing pressurized gas through the passages so that gas is discharged through said openings; and means for heating the platen, whereby the gas is heated before it is discharged through the openings and thereby heats and develops the emulsion.

3. Apparatus according to claim 1 wherein the transport means comprises sets of opposing, cooperating rollers between which the film passes, the rollers having a polished surface finish, and including means for rotating the rollers so that film disposed between them is transported in the direction of rotation of the rollers and wherein the film transport speed equals the surface speed of the rollers.

4. Apparatus for developing film having a substrate and a previously exposed light sensitive emulsion carried thereon, the apparatus comprising: a film developing station including a pair of opposing, spaced apart first and second platens, the spacing between the platens being greater than the thickness of the film, the first platen facing the emulsion; means for heating the first platen to a predetermined temperature; means for flowing pressurized gas through the first platen to heat the gas, the first platen defining a plurality of orifices distributed over the surface of the first platen facing the emulsion and fluidly connected with the gas flowing means; whereby heated gas is discharged from the orifices to form a gas bearing for the film and heat the emulsion to the developing temperature; transport means including means for feeding the film in a downstream direction to the developing station and means for withdrawing the film from the developing station, the withdrawing means including at least one surface engaging the film and moving at the same rate at which the film moves to prevent relative movements between such surface and the film and possible surface damage to the film.

5. Apparatus according to claim 4 wherein the withdrawing means comprises two opposing surfaces moving in like directions at speeds equal to the speed of the film, the surfaces having a highly polished surface finish to prevent the formation of surface irregularities on the film and on the heated emulsion.

6. Apparatus according to claim 5 wherein the surfaces are defined by pairs of opposite, cooperating rollers, the rollers having a hollow interior, and means for passing cooling air through the hollow roller interior.

7. Apparatus for developing and fixing exposed film having a light sensitive emulsion comprising:

a support structure defining an upstream and a downstream end for positioning of the upstream end adjacent a supply of exposed film, the support structure defining first, second and third cavities along a film travel path between the upstream end and the downstream ends;

first and second film heating platens for developing exposed film disposed in the first cavity in opposing relationship, the spacing between the platens being greater than the thickness of the film, means for heating the platens, and means defining a fluid flow passage through at least one of the platen facing the film emulsion;

means defining a multiplicity of orifices distributed over the face of said at least one platen, the orifices communicating with the flow passage so that pressurized air introduced into the flow passage is heated by the heating means and discharged through the orifices and against the film emulsion to thereby heat the film and form an air bearing for the film as it moves past the platens;

cooling means disposed in the second cavity in alignment with a gap between the platens in the first cavity and defining a narrow channel of a width greater than the thickness of the film for passing the film in a downstream direction through the channel, the cooling means defining a multiplicity of openings communicating with the channel for flowing cooling air into the channel to thereby cool film in the channel; means positioned in the third cavity for fixing developed film moving past the third cavity;

means for passing cooling air into the second cavity to thereby flow the cooling air through the openings into the channel to cool film therein; and transport means for moving the film from the upstream end of the support structure to the downstream end thereof.

8. Apparatus according to claim 7 including insulation applied to portions of the first and second platens in the first cavity facing the support structure to minimize the heat transfer therebetween and a heat loss by the platens.

9. Apparatus according to claim 7 wherein the transport means comprises a plurality of spaced apart sets of opposing rollers mounted to the support structure for grasping the sides of the film and moving the film along said path between the upstream and the downstream ends and wherein the spacing between the roller sets is less than the length of film being developed and fixed.

10. Apparatus according to claim 9 including means for passing cooling air into the third cavity for cooling the fixing means.

11. Apparatus according to claim 10 wherein there is a set of rollers downstream of the heating platens, downstream of the cooling means and downstream of the fixing means, each roller of the set including an axially extending hollow interior passage, one end of each roller including at least one opening communicating with one of the second and third cavities, another end of the roller including another opening, whereby cooling air directed into the second and third cavities also enters and axially flows through the interior of the rollers to thereby cool the rollers.

12. Apparatus according to claim 11 including means for rotating all rollers at a rate so that their surface speeds are equal.

13. Apparatus for developing and fixing an exposed microfiche having a light sensitive emulsion carried on a substrate comprising:

a closed housing having an inner chamber, an intake at an upstream end of the housing and an outlet at a downstream end for the housing for passing the microfiche through the chamber;

the housing chamber defining serially arranged first, second and third cavities between the intake and the outlet;

a developing station positioned in the first cavity and including means for heating the fiche to the developing temperature for the emulsion as the fiche passes the developing station;

a fiche cooling station positioned in the second cavity;

an emulsion fixing station positioned in the third cavity for fixing the previously developed and cooled emulsion of the fiche;

a pair of rollers positioned between adjacent cavities and adjacent the intake and the outlet;

at least rollers positioned between cavities and adjacent the outlet having a hollow interior and means communicating the hollow interior with the housing chamber, the rollers further including a polished surface finish so that film positioned between and in contact with the rollers is not damaged by surface irregularities of the rollers;

means for rotating the rollers of each pair in opposite directions to thereby move film disposed between each roller pair in a downstream direction through the housing;

and cooling means including a source of pressurized cooling air in fluid communication with the second and third cavities and with the communicating means in the rollers downstream of the developing station for cooling film at the cooling station, cooling the fixing station, and cooling such rollers.

14. Apparatus according to claim 13 including means for shielding the developing station from cooling air introduced into the housing.

15. Apparatus for developing and fixing film having a substrate and a previously exposed light sensitive emulsion carried thereon, the emulsion being of the type that is developed by heating it to its developing temperature, the apparatus comprising: a film developing station including opposing, spaced-apart first and second film guide means forming a path for the film past the developing station, the spacing between the film guide means being greater than the thickness of the film, the first film guide means facing the emulsion; means for flowing pressurized gas in contact with the first film guide means into a space between the first film guide means and the emulsion; means for heating the first film guide means to thereby heat the gas between first film guide means and the emulsion to at least the developing temperature; a fixing station downstream of the developing station for fixing the developed emulsion; and transport means for moving th film in a downstream direction between the film guide means past the developing station and thereafter past the fixing station; whereby the pressurized air forms an air bearing for the emulsion of the film as it moves past the film guide means and simultaneously therewith heat develops the emulsion without physically damaging it.

16. Apparatus according to claim 15 wherein the pressurized gas flowing means comprises a gas passageway through the first film guide means and orifice means in fluid communication with the passageway for discharging pressurized gas into the space between the film emulsion and the first film guide means.

17. Apparatus according to claim 16 wherein the orifice means comprises a multiplicity of orifices.

* * * * *